US005113995A

United States Patent [19]

Sakurai

[11] Patent Number: 5,113,995

[45] Date of Patent: May 19, 1992

[54] CHEESE CONVEYOR SYSTEM

[75] Inventor: Akira Sakurai, Inazawa, Japan

[73] Assignee: Kabushiki Kaisha Murao and Company, Kanazawa, Japan

[21] Appl. No.: 632,990

[22] Filed: Dec. 24, 1990

[51] Int. Cl.[5] ..... B65G 47/24

[52] U.S. Cl. ..... 198/409; 198/468.8; 242/35.5 A

[58] Field of Search ..... 198/409, 468.6, 468.8, 198/485.1, 486.1; 242/35.5 A

[56] References Cited

U.S. PATENT DOCUMENTS

| | | | |
|---|---|---|---|
| 2,348,112 | 5/1944 | Da Costa | 198/485.1 |
| 3,610,448 | 10/1971 | Bornfleth | 198/468.6 |
| 4,526,267 | 7/1985 | Harding et al. | 198/409 |
| 4,565,278 | 1/1986 | Asai et al. | 242/35.5 A |
| 4,763,773 | 8/1988 | Kawarabashi et al. | 198/409 |
| 4,850,472 | 7/1989 | Liebel et al. | 198/409 |
| 5,007,522 | 4/1991 | Focke et al. | 198/468.8 |

FOREIGN PATENT DOCUMENTS

| | | | |
|---|---|---|---|
| 468843 | 7/1975 | U.S.S.R. | 198/409 |

*Primary Examiner*—Joseph E. Valenza

*Attorney, Agent, or Firm*—Oblon, Spivak, McClelland, Maier & Neustadt

[57] ABSTRACT

The present invention relates to a cheese conveyor system for conveying cheeses wound by a winder, wherein hangers each supporting a lower portion in an outer peripheral surface of a cheese from opposite sides thereof are provided on a ceiling conveyor, and forks are provided on loaders and unloaders whereby either parallel cheeses or cone cheeses can be conveyed without changing the apparatus structure, and the loaders and the unloaders are of the same construction whereby either function of the loader and the unloader can be accomplished by changing the operating method to reduce the installation costs.

6 Claims, 9 Drawing Sheets

11
11a
11b
11c
11d
11a1
12
12a
12b
12c
13
10
20
23
24
K2
K3a
K3b
K4
C1
C2
M1

C
P1
24
20
25
23

C
24
P2
23
25
24

11
10
C
24
P3
23
25
12
24

11
12
C
24
23
25
24

P1
24
23
25

CHEESE CONVEYOR SYSTEM

BACKGROUND OF THE INVENTION

This invention relates to a cheese conveyor system for conveying cheeses wound in a spinning mill or the like.

In a spinning mill or the like, as a cheese conveyor system for conveying a cheese (which includes both a parallel cheese and a cone cheese) wound into a predetermined shape by a winder, a ceiling conveyor has been widely utilized.

This conveyor has a guide pipe which interiorly houses a conveyor chain which is bendable up and down and to left and right, said conveyor chain having a number of hangers, on which cheeses are individually hung to convey the cheeses along the guide pipe.

In the ceiling conveyor constructed as described above, hangers of different type have been used to convey parallel cheeses or cone cheeses. For the former, a hanger of the type in which opposite ends of a cheese core are supported is used, whereas for the latter, an L-shape hook to be inserted into the cheese core is used.

Different type of a loader for loading cheeses on the ceiling conveyor and an unloader for unloading cheeses from the ceiling conveyor have been employed depending on the shape of cheeses.

Since different type of hangers, loaders and unloaders are to be used depending on the shape of cheeses, the cheese conveyor system is inevitably of exclusive use for cheeses having a specific shape, which has no universality and is inconvenient. Because, the shape of cheeses may be suitably switched according to kinds of yarns, charged quantity of yarns, etc.

In addition, the loaders and unloaders are of different types from each other, and therefore, there rises a drawback that equipment costs increase.

OBJECT OF THE INVENTION

It is a first object of the present invention to provide a cheese conveyor system which can stably support either parallel cheeses or cone cheeses to convey them. In the present invention, the loader or the unloader for transferring cheeses can be applied to either parallel cheeses or or cone cheeses, and the structure of the whole conveyor system and the number of equipments are reduced to realize the lowering of costs.

DISCLOSURE OF THE INVENTION

The structure of this invention for achieving the aforesaid objects resides in the subject matter which comprises a ceiling conveyor which is opened in a lower portion and front and rear portions thereof and provided with hangers for embracing a cheese from opposite sides to convey it, loaders for transferring cheeses on an in-conveyor to the hangers, and an unloader for transferring cheeses being conveyed by the hangers to an out-conveyor, said loader and said unloader being formed to have the same type which is provided with a fork for supporting a cheese from the bottom.

The loader and unloader may be provided with a turning guide for changing the direction of the fork while the fork is moved up and down, and the fork may be stopped at a suitable position halfway of vertical movement thereof.

BRIEF DESCRIPTION OF THE DRAWINGS

FIGS. 1 to 8 show typical embodiments of the present invention, in which FIG. 1 is a conceptual view of the overall structure;

FIG. 2 is a front explanatory view of an unloader;

FIG. 3 is a side explanatory view of FIG. 2;

FIG. 4 is an enlarged perspective explnatory view showing essential parts of FIG. 3;

FIGS. 9 to 12 show another embodiments of the present invention, in which FIG. 9 is a partly sectioned perspective explanatory view of the loader;

FIG. 10 is a plan explantory view of essential parts showing the relationship between the loader and the in-conveyor;

FIG. 11 is a side explantory view of FIG. 10;

FIG. 12 is a side explanatory view of essential parts showing the relationship between the other loader and the in-conveyor.

DETAILED DESCRIPTION OF THE INVENTION

Figure 1:
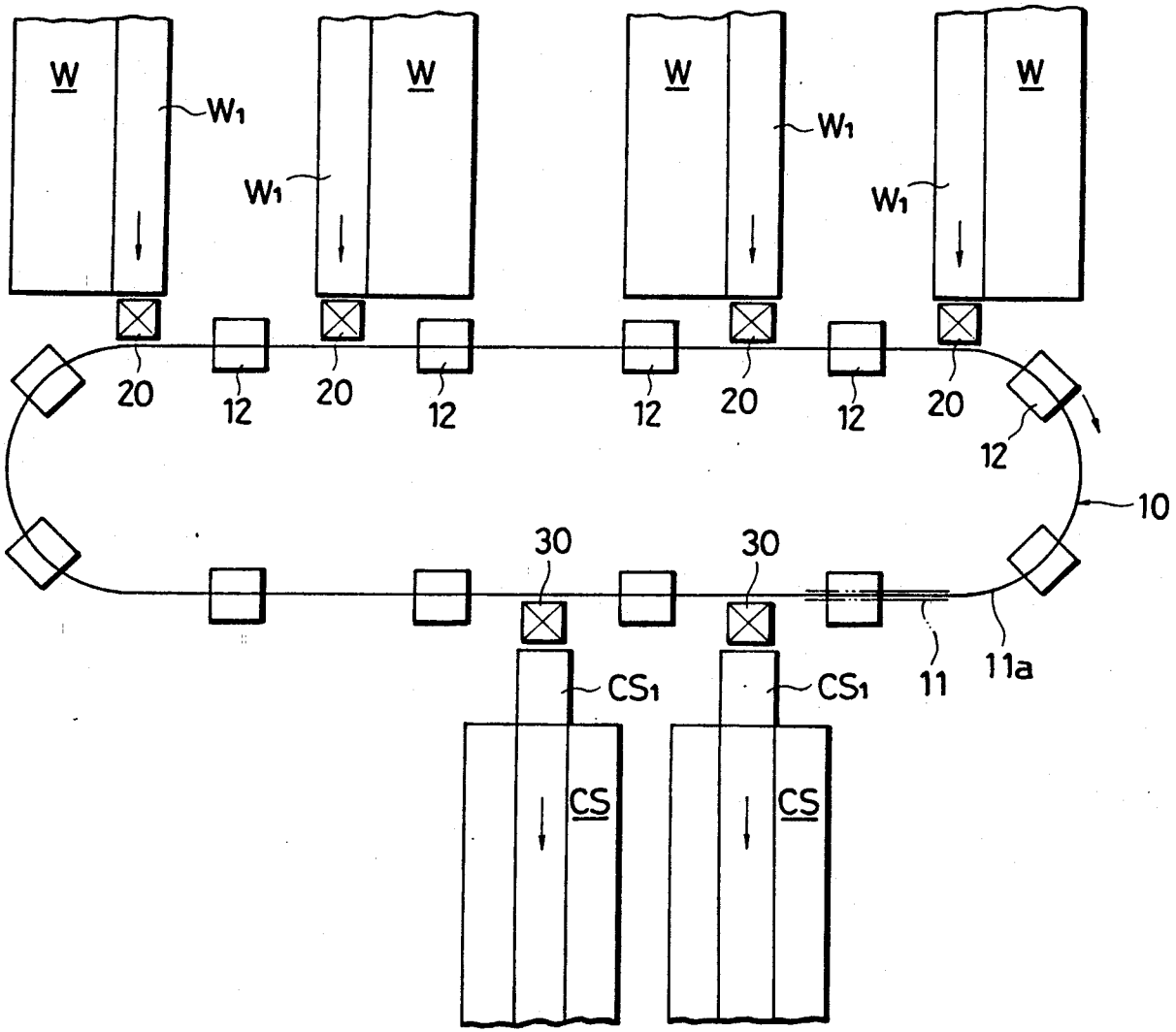

The cheese conveyor system comprises a combination of a circulation travel type ceiling conveyor 10, a plurality of loaders 20, 20 . . . and a plurality of unloaders 30, 30 . . . Suitable number of loaders 20, 20 . . . and unloaders 30, 30 . . . may be used, and in the illustration, four loaders and two unloaders are used.

Each loader is disposed at the distal end of a cheese out-conveyor $W_1$ for a winder W. Accordingly, a cheese wound by the winder W is placed on the cheese out-conveyor $W_1$ and conveyed toward the loader 20, and is individually transferred onto a hanger 12 of the ceiling conveyor 10 (The cheese out-conveyor $W_1$ serves to carry the cheese into the ceiling conveyor 10, which is hereinafter also referred to as the in-conveyor $W_1$).

Each unloader 30 is disposed at the start end of a cheese in-conveyor $CS_1$ of a cheese stocker CS. A cheese conveyed by the hanger 12 which moves along the ceiling conveyor 10 is individually removed from the hanger 12 by the unloader 30 and transferred onto the cheese in-conveyor $CS_1$. The cheese in-conveyor $CS_1$ serves to carry the cheese out of the ceiling conveyor 10, which is hereinafter referred to as the out-conveyor $CS_1$.

Both the in-conveyor $W_1$ and out-conveyor $CS_1$ are of the belt conveyor which can be intermittently operated. The loaders 20, 20 . . . and unloaders 30, 30 . . . are stood upright immediately below the moving path of the ceiling conveyor 10.

The loaders 20 and unloaders 30 have exactly the same construction (In the ensuing description, reference numerals (20+i) and (30+i), where members indicated by i=1, 2 . . . designate the same members.).

Figure 2:
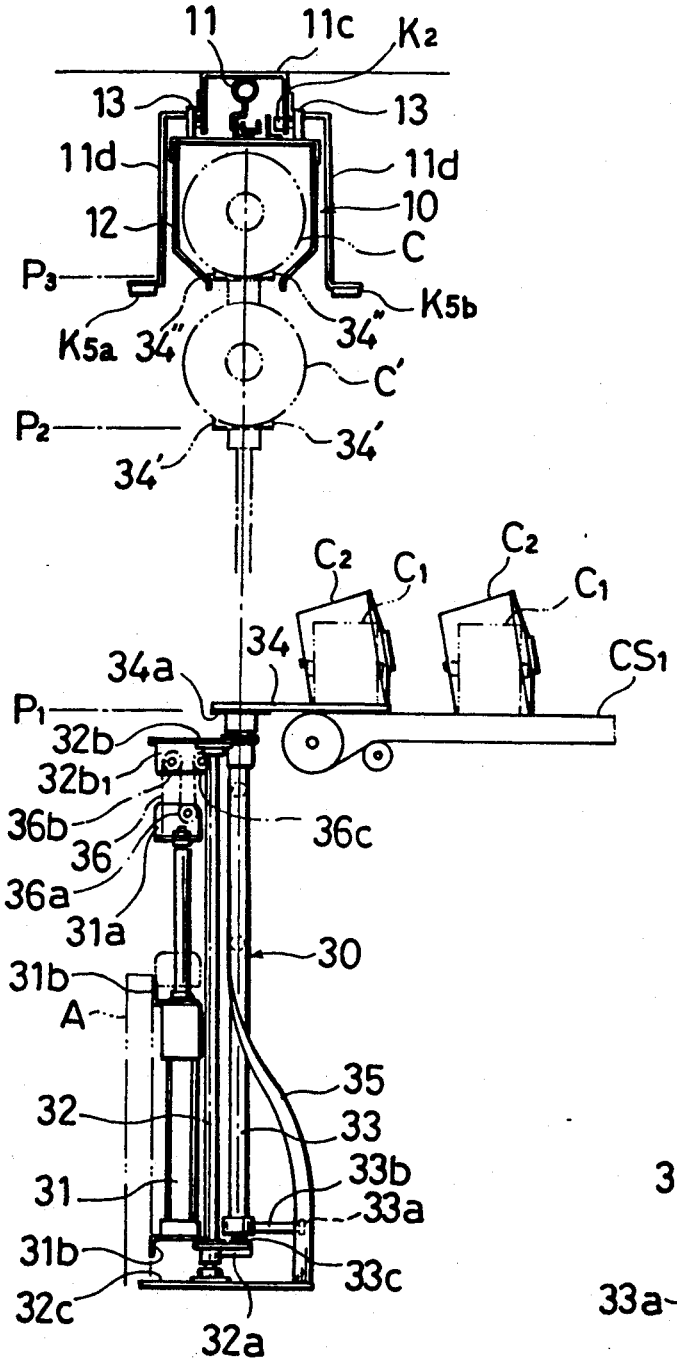
Figure 3:
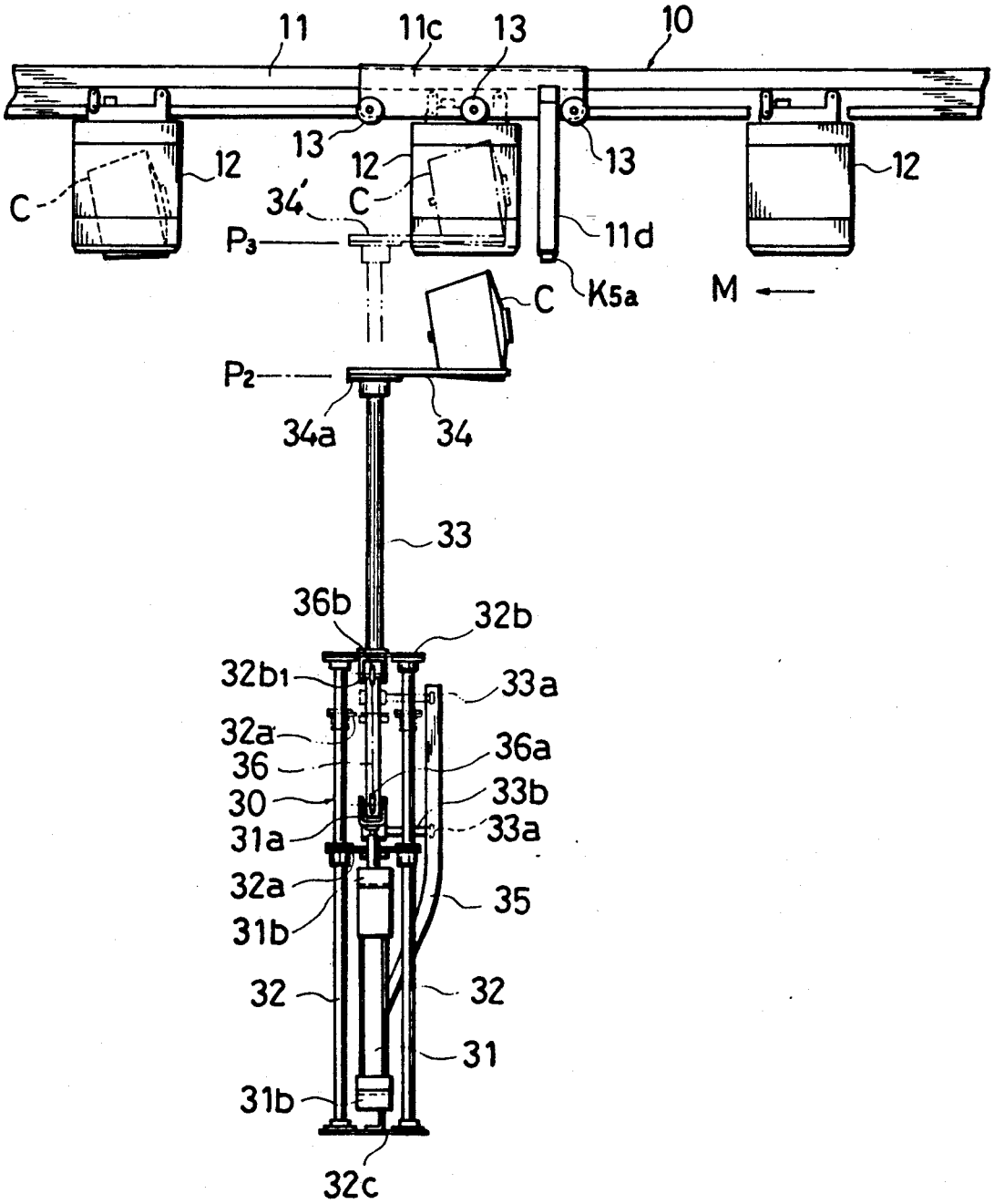

As shown in FIGS. 2 and 3, the unloader 30 principally comprises an air cylinder 31, guide rods 32, 32, an elevating rod 33, forks 34, 34, and a turning guide 35.

The guide rods 32 and 32 are stood upright in parallel on opposite sides of a base bracket 32*c*, and upper ends thereof is connected by a fixed bracket 32*b*. A movable bracket 32*a* (see FIG. 4) is slidably fitted in the guide rods 32 and 32.

The air cylinder 31 is secured to a fixed member A through mounting members 31*b* and 31*b*, and a sprocket 36*a* is mounted on the extreme end of a rod of the air cylinder 31 through a bracket 31*a*. A support plate 32*b*$_1$ is mounted on the fixed bracket 32*b*, and sprockets 36*b* and 36*c* are rotatably provided thereon. One bracket 31*a* and the movable bracket 32*a* are connected by a chain 36. The chain 36 is connected to the movable bracket 32*a* from the bracket 31*a* via sprockets 36*b*, 36*a* and 36*c*. It is to be noted that a rope-like member such as a rope may be used in place of the chain 36.

Figure 4:
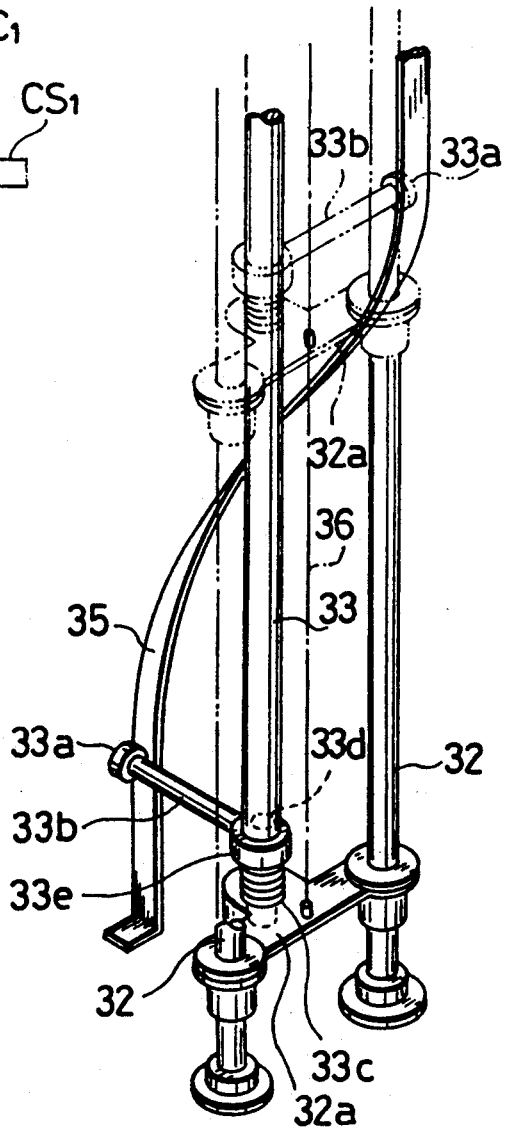

A guide rod 33*b* with a roller 33*a* is projected from the lower end of the elevating rod 33 through a fixed ring 33*e* as shown in FIG. 4, and the lower end of the elevating rod 33 is supported rotatably with respect to a short shaft 33*d* attached to a movable bracket 32*a* with a torsional spring 33*c* interposed between a fixed ring 33*e* and the movable bracket 32*a*. The torsional spring 33*c* imparts the elevating rod 33 a turning force in a direction in which the roller 33*a* always presses one surface of the turning guide 35. The upper end of the elevating rod 33 slidably extends through the fixed bracket 32*b* as shown in FIGS. 2 and 3.

On the upper end of the elevating rod 33 are horizontally projected forks 34 and 34 through a bracket 34*a*. The lower end of the turning guide 35 is secured to the base bracket 32*c*, and the upper end thereof is extended to and near the fixed bracket 32*b*, which forms a web-like member twisted by 90 degrees about the elevating rod 33.

Accordingly, when the air cylinder 31 is expanded, the elevating rod 33 is moved up and down through the chain 36 or the like, and the stroke of the elevating rod 33 is three times of expansion stroke of the air cylinder 31 through the sprockets 36*a* and 36*b*$_1$. The forks 34, 34 can be turned by 90 degrees by the turning guide 35 in response to the elevating operation. It is to be noted that stop positions of the forks 34, 34 may take a down position $P_1$, a standby position $P_2$ and an up position $P_3$.

Figures 5A, 5B:
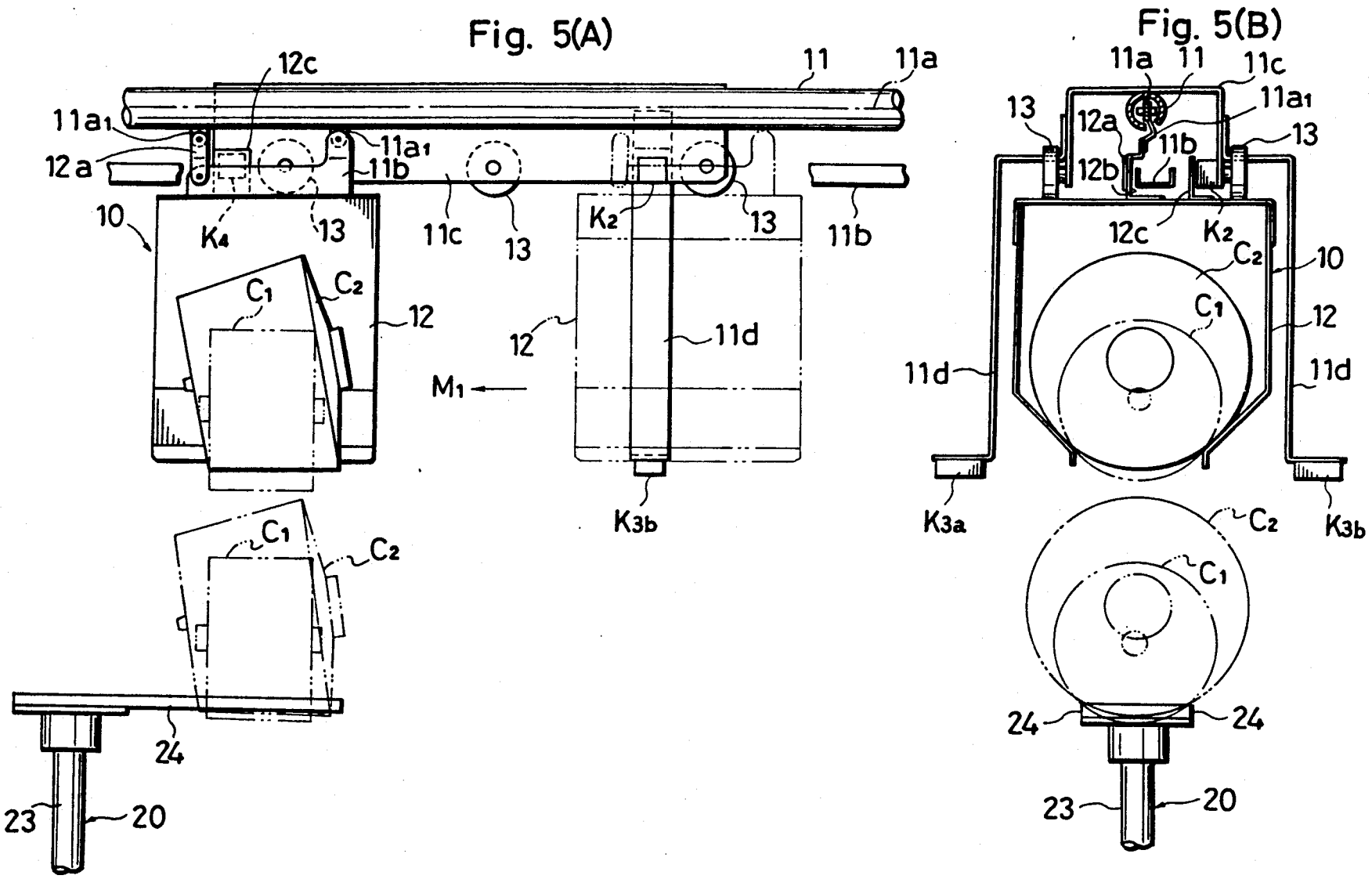
FIG. 5(A) is a side explanatory view of essential parts showing the relationship between the loader and the ceiling conveyor.
FIG. 5(B) is a front explanatory view of FIG. 5(A)

The ceiling conveyor 10 has a guide pipe 11 housing a bendable conveyor chain 11*a* as shown in FIGS. 5(A) and 5(B), and a number of hangers 12, 12 . . . are hung on the conveyor chain 11*a*. The hanger 12 is of an inverted U shape, and has plates of which lower portion is obliquely bended on the central side suspended on opposite sides to form a short tunnel shape with a lower portion and front and rear ends opened. Thereby, the hanger 12 can hold either parallel cheese $C_1$ or cone cheese $C_2$ (hereinafter merely referred to as cheese C) in a manner of being embraced. The hanger 12 is hung on hanging rings 11*a*$_1$, 11*a*$_1$ of the conveyor chain 11*a* through fittings 12*a*, 12*b* secured to the upper surface thereof, and a detection plate 12*c* is mounted frontwardly on the upper surface of the hanger 12. A trough-like tray 11*b* is disposed below the guide pipe 11.

On the other hand, upwardly of the loader 20, a station 11*c* of the ceiling conveyor 10 is fixedly disposed on the guide pipe 11 as shown in FIG. 5(A), and rollers 13, 13 . . . for preventing oscillations of the hangers 12, 12 . . . are mounted on the side of the station 11*c*. When the ceiling conveyor 10 moves in a direction as indicated at arrow $M_1$ of FIG. 5(A), a proximity sensor $K_2$ for detecting an approach of the hanger 12 is disposed internally of the end upstream of the station 11*c*, and photoelectric sensors $K_{3a}$, $K_{3a}$ for detecting the presence or absence of the cheese C within the hanger 12 moved close to the loader 20 are disposed on the lower surfaces of arms 11*d*, 11*d* vertically provided on the side of the station 11*c*. Internally of the station 11*c* positioned substantially directly above the loader 20 is provided a proximity sensor $K_4$ for detecting that the hanger 12 is at a predetermined transfer position. It is to be noted that these proximity sensors $K_2$ and $K_4$ are operated in sensitive to the detection plate 12*c* of the hanger 12*c*.

As shown in FIG. 2, the station 11*c* of the ceiling conveyor 10 is also disposed upwardly of the unloader 30. Rollers 13, 13 . . . for preventing oscillations of the hangers 12 are mounted on the side of the station 11*c*, and phtoelectric sensors $K_{5a}$ and $K_{5b}$ for detecting the presence of absence of the cheese C within the hanger 12 moving close to the unloader 30 are provided on the lower surface of the arms 11*d* and 11*d* vertically provided upstream of the station 11*c*.

Forks 24, 24, 34, 34 of the loader 20 and the unloader 30 are sufficiently close to the hangers 12 at the standby position $P_2$ (see FIG. 3), and can hold the cheeses C internally of the hangers 12 at the up position $P_3$. The forks 24, 24, 34, 34 when not holding the cheeses C may pass through vertically of the lower open portion of the hangers 12. The forks 34 and 34 of the unloader 30 can be positioned parallel to or substantially the same level as the out-conveyor $CS_1$ at the down position $P_1$.

Figure 6A:
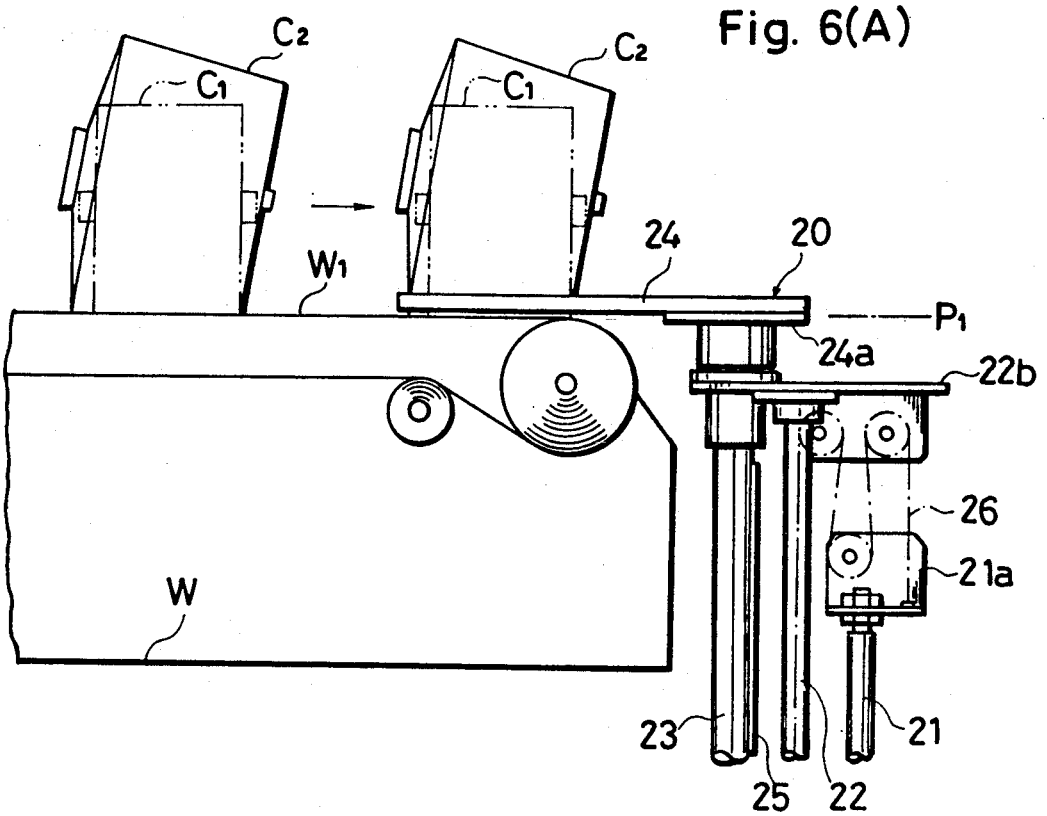
FIG. 6(A) is a side explanatory view of essential parts showing the relationship between the loader and the in-conveyor.
Figure 6B:
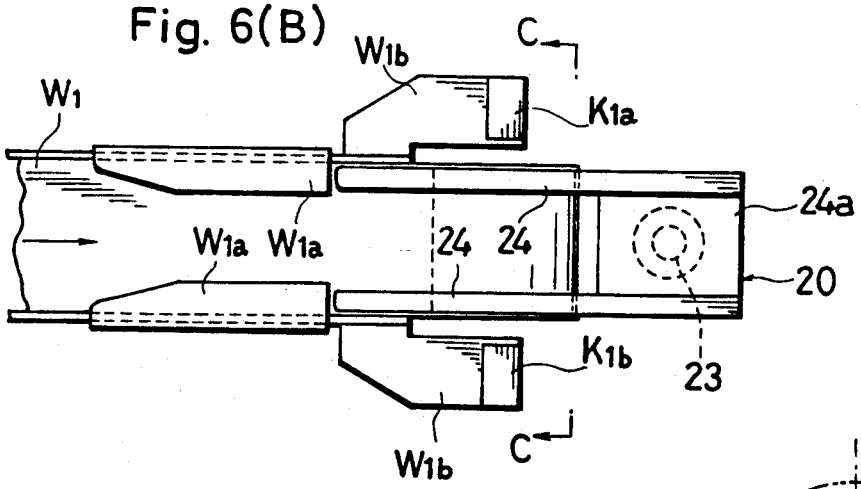
FIG. 6(B) is a plan explanatory view of essential parts of FIG. 6(A)
Figure 6C:
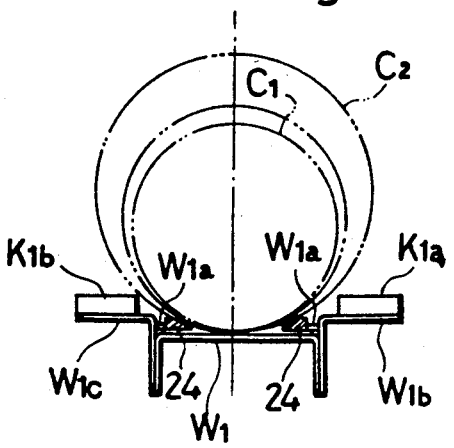
FIG. 6(C) is a sectional view taken on line C—C of FIG. 6(B)

On the other hand, defining plates $W_{1a}$, $W_{1a}$ for correcting the attitude of the cheeses C are disposed in the vicinity of the end of the in-conveyor $W_1$ as shown in FIGS. 6(B) and 6(C). When the loader 20 assumes the down position $P_1$, the forks 24, 24 are parallel to and substantially the same level as the in-conveyor $W_1$. So, the cheeses C being conveyed on the in-conveyor $W_1$ can be located and stopped on the forks 24, 24. Here, locating photoelectric sensors $K_{1a}$ and $K_{1b}$ for stopping the in-conveyor $W_1$ are disposed on side plates $W_{1b}$ and $W_{1b}$ provided on the opposite sides of the in-conveyor $W_1$.

Figures 7A, 7B, 7C, 7D, 7E:
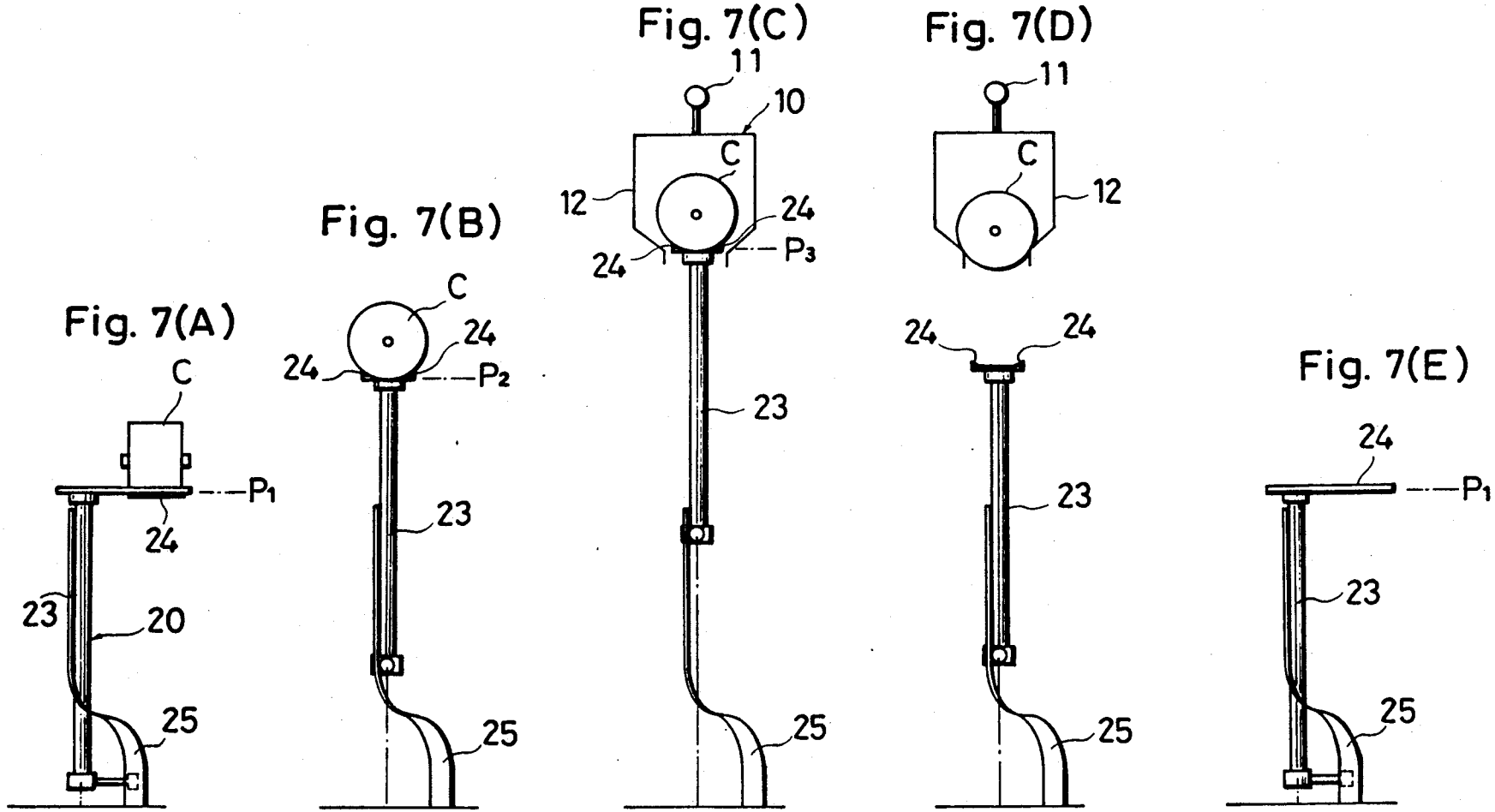
FIGS. 7(A) to 7(E) are explanatory views for the operation of the loader.

The transferring operation of the cheeses C will now be described in detail with reference to FIGS. 7(A) to 7(E). As shown in FIG. 7(A), the loader 20 is at the down position $P_1$, and the cheeses C on the in-conveyor $W_1$ are transferred onto the forks 24 and 24 and stop. When the photoelectric sensors $K_{1a}$ and $K_{1b}$ are activated, the elevating rod 23 moves up to the standby position $P_2$ as shown in FIG. 7(B). At this time, the elevating rod 23 is moved along the turning guide 25 and rotated by 90 degrees, and the attitude of the cheeses C become parallel to the moving direction of the ceiling conveyor 10.

When an empty hanger 12 moves close to the loader 20 and the proximity sensor $K_2$ and the photo-electric sensors $K_{3a}$ and $K_{3b}$ disposed on the station 11*c* of the ceiling conveyor 10 are activated, the elevating rod 23 moves up to the up position $P_3$ as shown in FIG. 7(C). When the hanger 12 moves close to and the cheese C moves into the hanger 12, the proximity sensor $K_4$ is activated so that the up loader 23 is moved down to the down position $P_1$ at once as shown in FIGS. 7(D) and 7(E). Thereby, the cheeses C on the forks 24 and 24 are transferred into the hangers 12, and the transfer thereof from the loader 20 to the ceiling conveyor 10 is completed. The forks 24 and 24 are turned reversely by 90 degrees during the down movement thereof to the down position $P_1$ and return to their original attitude.

The transfer of the cheeses C to the unloader 30 will be described hereinafter with reference to FIGS. 8(A) to 8(D).

Figure 8D:
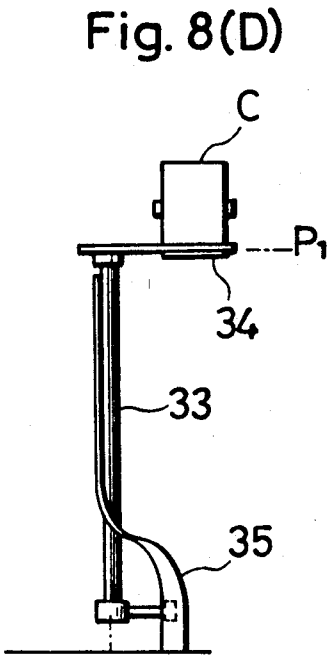
FIGS. 8(A) to 8(D) are explanatory views for the operation of the unloader.
Figure 8C:
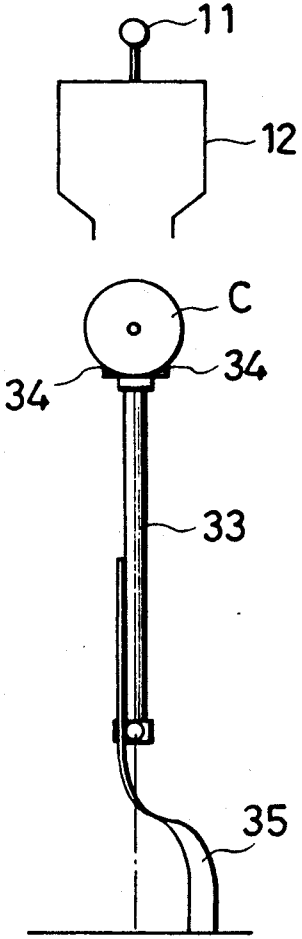
Figure 8B:
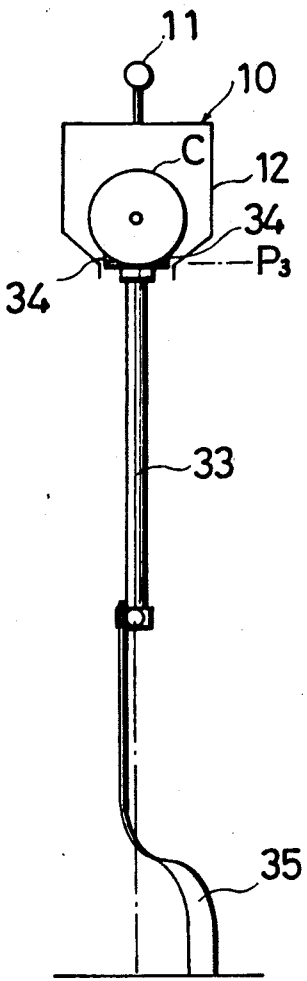
Figure 8A:
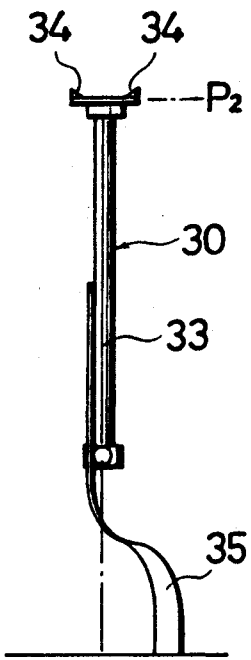

As shown in FIG. 8(A), the unloader 30 causes the elevating rod 33 to be positioned at the standby position $_2$. At this time, the forks 34 and 34 are parallel to the moving direction of the ceiling conveyor 10.

When the hangers 12 having the cheeses C therein approach, the proximity sensor $K_2$ and the photoelectric sensors $K_{5a}$ and $K_{5b}$ are activated so that the elevating rod 33 moves up to the up position $P_3$ as shown in FIG. 8(B). The forks 34 and 34 are moved into the approaching hangers 12 from the lower openings thereof, and therefore, timing between the up speed of the elevating rod 33 and the moving speed of the hangers 12 is adjusted in advance. Thereby, the forks 34 and 34 push up the cheeses C within the hangers 12 to transfer them to the forks 34 and 34.

After the hangers 12 have passed through the position of the unloader 30, the forks 34 and 34 are moved down to the down position $P_1$ at once as shown in FIGS. 8(C) and 8(D). Then, the cheeses C can be moved to the same level as the out-conveyor $CS_1$ and can be transferred to the out-conveyor (see FIG. 2). It is noted that the direction of the cheeses C at the down position $P_1$ is changed to that parallel to the moving direction of the out-conveyor $CS_1$ because the elevating rod 33 is rotated along the turning guide 35. When the cheeses C on the forks 34 and 34 are carried away by the out-conveyor $CS_1$, the elevating rod 33 is returned to the standby position $P_2$ and stands-by (see FIG. 8(A)).

If suitable numbers are applied to hangers 12, 12 . . . of the ceiling conveyor 10, positions of all the hangers 12, 12 . . . are pursued and stored and kinds of cheeses C transferred to the hangers 12 by the loaders 20, 20 . . . , only predermined kinds of cheeses C are selected by the unloaders 30, 30 . . . to put them on the specific out-conveyor $CS_1$.

It is noted that the cheese stocker CS may be of an inspection and packing line. The turning guides 25 and 35 of the loader 20 and unloader 30 are provided to adjust the direction of the forks 24, 24, 34, 34 to the moving direction of the ceiling conveyor 10 and the in-conveyor $W_1$ or out-conveyor $CS_1$, and therefore, the turning angle thereof can be selected to a suitable angle other than 90 degrees.

OTHER EMBODIMENTS

Since the loader 20 and the unloader 30 are formed by a similar construction, the other embodiments of the present invention will be described with the loader as a typical example.

Figure 9:
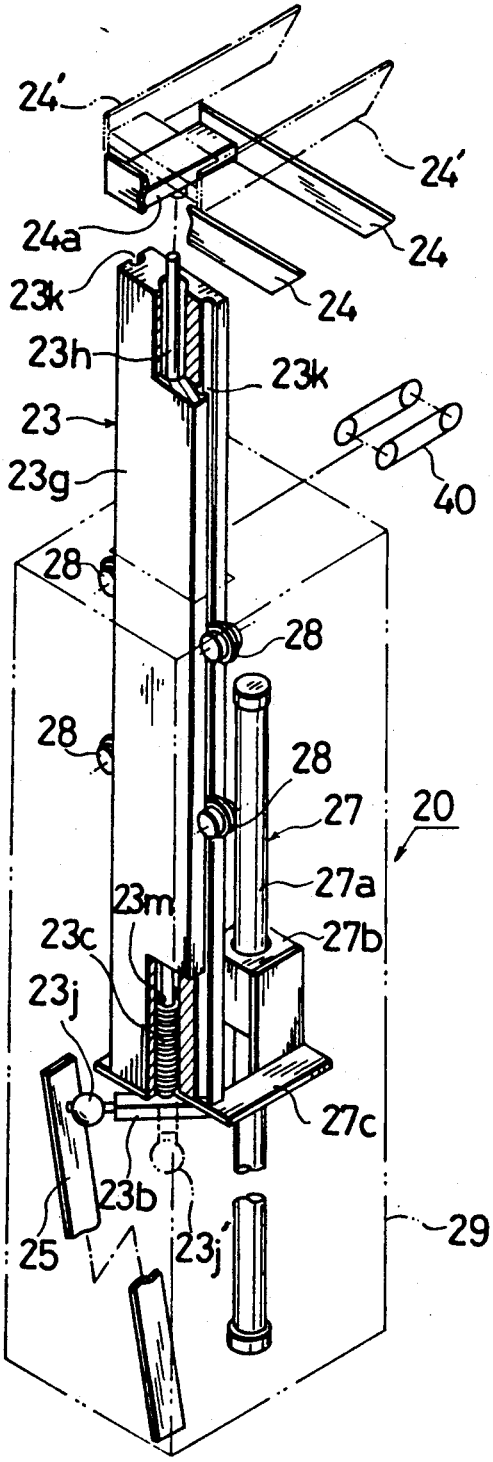

As shown in an example of FIG. 9, the loader 20 principally comprises a rodless cylinder 27, an elevating rod 23, forks 24, 24, a turning guide 25 and a mini-conveyor 40.

The elevating rod 23 comprises an elevating member **23*g* having a rectangle in section and a shaft 23*h*, the shaft 23*h* rotatably extending through a longitudinal central portion of the elevating member 23*g*. The forks 24 and 24 are horizontally projected on the upper end of the shaft 23*h* though a bracket 24*a*, and a guide rod 23*b* with a ball 23*j* is secured to the lower end thereof. A torsional spring 23*c* is mounted at the lower portion of the shaft 23*h* and fixed by a stop pin 23*m* which extends through the shaft 23*h*. The torsional spring 23*c* imparts a turning force to the shaft 23*h* in a direction in which the ball 23*j* always presses one surface of the turning guide 25. The shaft 23*h* is designed so that it turns by 90 degrees till the ball 23*j* reaches the upper end of the turning guide 25** but will not further rotate.

The elevating member **23*g* is secured to a bracket 27*c* having its lower end mounted on a movable table 27*b* of the rodless cylinder 27, and it is moved up and down on the movable table 27*b* of the rodless cylinder 27 whereby the elevating member 23*g* can be moved up and down along guide rollers 28, 28 . . . with the same stroke. However, are engaged with guide grooves 23*k* and 23*k* formed in the side of the elevating member 23*g* mounted on a body 29 of the loader 20. The rodless cylinder 27 can stop the forks 24 and 24** at positions corresponding to the down position $P_1$, standby position $P_2$ and up position $P_3$ by a locating mechanism comprising a proximity switch not shown.

The turning guide 25 comprises a straight web-like member and maintains a point contact with the ball **23*j* whereby the shaft 23*h* and the forks 24 and 24** can turn by 90 degrees during the vertical movement.

Figure 10:
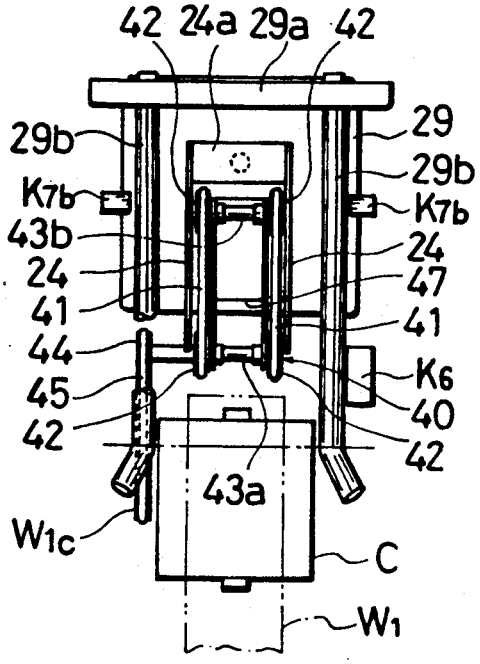
Figure 11:
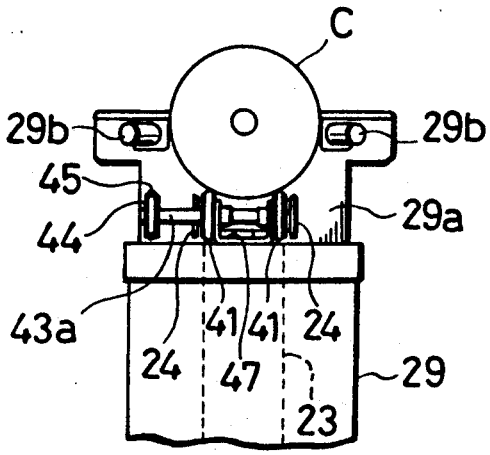

A bracket **29*a* is stood upright, as shown in FIG. on the upper surface side of the body 29 of the loader 29, cheese guide rods 29*b* and 29*b* are horizontally mounted through the bracket 29*a*, and the mini-conveyor 40 is mounted as shown in FIG. 10 between the cheese guides 29*b* and 29*b***.

The mini-conveyor 40 has shafts **43*a* and 43*b* rotatably extended through both front and rear ends of a frame 47 thereof, pulleys 42, 42 . . . are mounted along both sides of the frame 47 with respect to the shafts 43*a* and 43*b*, and a round belt 41 is passed over the pulleys 42 and 42. The front shaft 43*a* extends on one side, and a driving pulley 44 is mounted on the extreme end threof. The driving pulley 44 is connected to a pulley $W_{1c}$ of the in-conveyor $W_1$ through a round belt 45** (see FIG. 12).

It is to be noted that the forks 24 and 24 are parallel with the cheese guides **29*b* and 29*b* and the mini-conveyor 40 at the down position $P_1$, and positioned on both external sides of the mini-conveyor 40 and turned in the moving direction of the ceiling conveyor 10** at the up position $P_3$.

Externally of the cheese guide rods **29*b* and 29*b* are disposed photoelectric sensors $K_{7a}$ and $K_{7b}$ for detecting the presence or absence of the cheeses C on the mini-conveyor 40 as shown in FIG. 10. A locating photo-electric sensor $K_6$ for stopping the in-conveyor $W_1$ is disposed between the mini-conveyor 40** and the in-conveyor $W_1$.

More specifically, in the operation of this apparatus, when the loader 20 is at the down position $P_1$, the cheese C on the in-conveyor $W_1$ intercepts the photoelectric sensor $K_6$. Then the in-conveyor $W_1$ stops after a predetermined time from that time whereas the cheese C stands still on the mimi-conveyor 40. The photo-electric sensors $K_{7a}$ and $K_{7b}$ are activated so that the elevating rod 23 moves up to the standby position $P_2$ with the cheeses C placed on the forks 24 and 24. Thereafter operation is exactly the same as that of the previous embodiment. Since the cheeses C are guided on the round belts 41 and 41 of athe mini-conveyor 40, and therefore, the cheeses C can be positively transferred by the forks 24 and 24 of the loader 20.

When the loader 20 is used as the unloader 30, when the forks 24 and 24 receive the cheeses C at the up position $P_3$ and moves down to the down position $P_1$, the out-conveyor $CS_1$ is started by the activation of the photo-electric sensors $K_{7a}$ and $K_{7b}$ and the cheese C are transferred from the mini-conveyor 40 the out-conveyor $CS_1$ and ejected.

Figure 12:
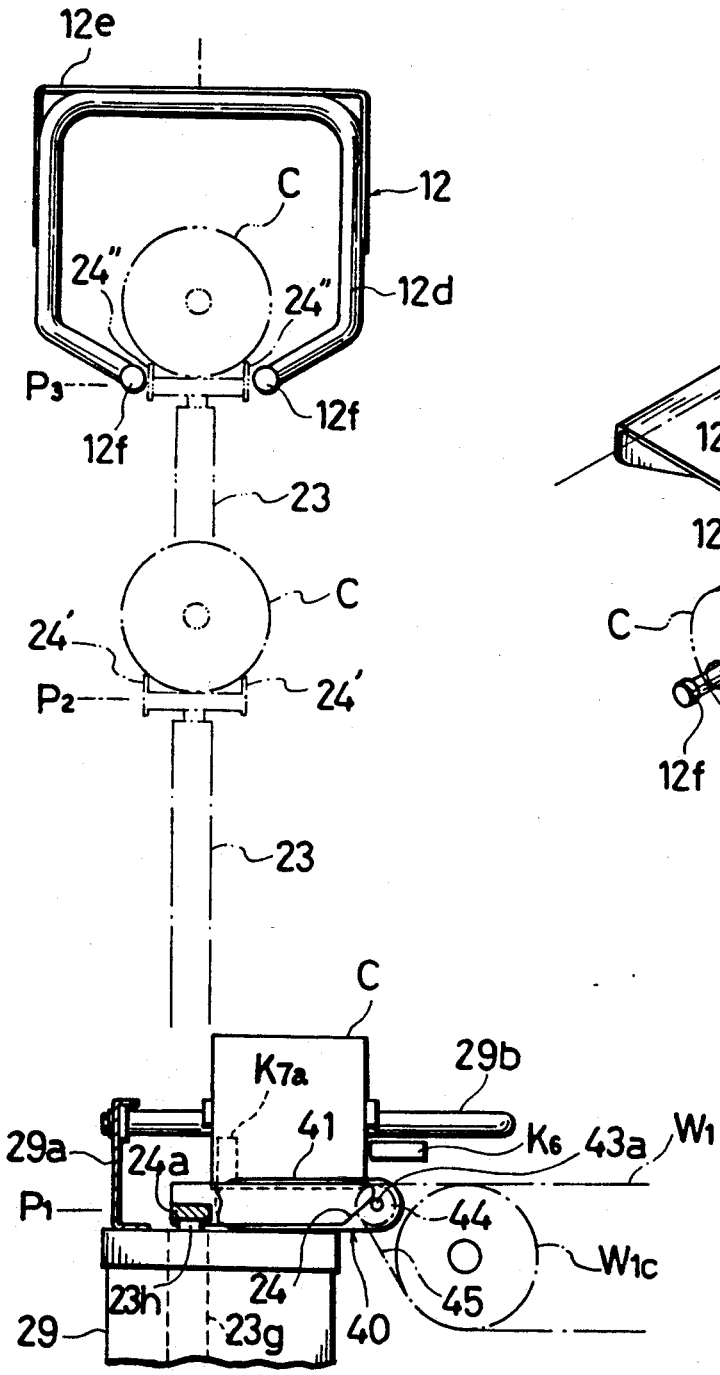
Figure 13:
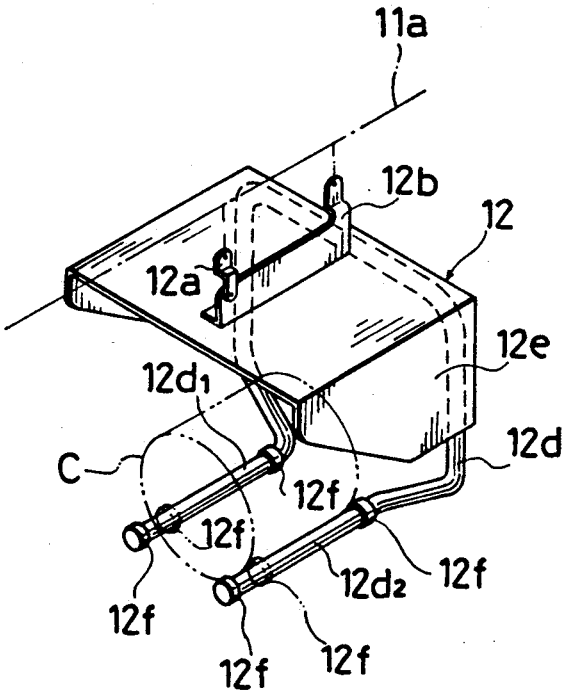
FIG. 13 is a perspective explanatory view showing another embodiment of the hanger.

As shown in FIGS. 12 and 13, the hanger 12 may comprises a support portion 12*d* comprising a pipe-like member, a feed 12*e* comprising a plate-like member, and fittings 12*a* and 12*b*. The support portion 12*d* is secured to the rear inner surface of a hood 12*e*, and two straight portions $12d_1$ and $12d_2$ projecting in parallel in the moving direction are provided to support the cheese C from the bottom. Ring-like locating members 12*f*, 12*f*. . . ar mounted on the straight portions $12d_1$ and $12_{d2}$, and fittings 12*a* and 12*b* to be mounted on a conveyor chain 11*a* are secured to the upper surface of the hood 12*e*.

The forks 24 and 24 of the loader 20 and the forks 34 and 34 of the unloader 30 can vertically pass between the straight portions $12d_1$ and $12d_2$ of the support portion 12*d*, and the forks 34 and 34 of the unloader 30 can pass in front and at the rear of the hangers 12 in the state of supporting the cheeses C from the bottom. Therefore, exactly the same operation as that of the previous embodiment can be accomplished.

Since the support portion 12*d* is strong in flexture since it comprises a single pipe-like member. Even if the support portion 12*d* is used for a long period of time, the spacing between the straight portions $12d_1$ and $12d_2$ is not possibly spread due to the weight of the cheeses C. The locating members 12*f*, 12*f*. . . are moved to a suitable position along the straight portins $12d_1$ and $12d_2$ (as indicated by the dash-dotted contour lines), whereby the cheeses C irrespective of their size can be stably supported.

As described above, according to the present invention, there comprises a ceiling conveyor provided with hangers embracing and conveying cheeses, loaders for transferring the cheeses on an in-conveyor to the hangers and unloaders for transferring the cheeses being conveyed by the hangers to an out-conveyor, the loaders and unloders being provided with forks for supporting the cheese from the bottom, whereby the ceiling conveyor, the loaders and the unloders can stably supprt cheeses comprising either parallel cheeses or cone cheeses, since the hangers or forks contact the outer peripheral surfaces of the cheeses in parallel two straight-line manner. Furthermore, the transferring method for the cheeses can be of a common type irrespective of cheeses, and therefore, any cheeses can be handled without trouble. In addition, since the loader and the unloader are of the same type, these need not be prepared every shape of the cheeses. Furthermore, the loaders and unloaders can be used as one for another by changing the operating method, thus providing excellent effects capable of materially reducing the system costs.

What is claimed is:

1. A cheese conveyor system for conveying cheeses wound by a winder, wherein:

a ceiling conveyor which is opened in front and rear portions in a moving direction and a lower portion and provided with hangers for supporting a lower portion of an outer peripheral surface of a cheese from opposite sides thereof is horizontally extended;

loaders for transferring a cheese to said hanger are disposed, on the winder side, at suitable positions along said ceiling conveyor;

unloaders for removing the cheese from the hanger are provided at suitable positions along said ceiling conveyor;

said loaders and unloaders are formed to have the same construction, and a pair of forks for supporting the lower portion of the outer peripheral surface of the cheese from opposite sides thereof are provided above said loaders and said unloaders so that said forks can freely pass through lower openings of said hangers;

said loader and said unloader are provided with an elevating device with said forks disposed at the upper portion thereof and provided with a turning guide for changing the direction of the forks; and said elevating device is provided with an elevating member connected to a rodless cylinder and having a fork at the upper portion thereof.

2. A cheese conveyor system according to claim 1, wherein said unloaders are provided at the end of a cheese stocker.

3. A cheese conveyor system for conveying cheeses wounded by a winder, wherein:

a ceiling conveyor which is opened in front and rear portions in a moving direction and a lower portion and provided with hangers for supporting a lower portion of an outer peripheral surface of a cheese from opposite sides thereof is horizontally extended;

loaders for transferring a cheese to said hanger are disposed, on the winder side, at suitable positions along said ceiling conveyor;

unloaders for removing the cheese from the hanger are provided at suitable portions along said ceiling conveyor;

said loaders and unloaders are formed to have the same construction, and a pair of forks for supporting the lower portion of the outer peripheral surface of the cheese from opposite sides thereof are provided above said loaders and said unloaders so that said forks can freely pass through lower openings of said hangers;

said loader and said unloader are provided with an elevating device with said forks disposed at the upper portion thereof and provided with a turning guide for changing the direction of the forks; and said turning guide is formed onto a straight web-like form, an upper end and a lower end thereof being disposed to be displaced in horizontal direction, and a guide rod having a ball at the extreme end thereof and urged toward a plane on one side of said turning guide is mounted on a shaft connected to said fork.

4. A cheese conveyor system according to claim 1, wherein the forks in said loader and said unloader can be located and stopped at a down position, a standby position and an up position.

5. A cheese conveyor system according to claim 1, wherein said hanger is provided with a pipe-like support portion, said support portion being formed at the lower end with parallel straight portions spaced larger than the width between said forks and smaller than the diameter of the cheese.

6. A cheese conveyor system according to claim 1, wherein a pair of mini-conveyors parallel with said forks at a down position and for individually transferring the cheese between said forks are disposed on said loader and said unloader.

* * * * *